US005303638A

United States Patent [19]

Green

[11] Patent Number: 5,303,638

[45] Date of Patent: Apr. 19, 1994

[54] RODLESS PISON AND CYLINDER ASSEMBLY FOR A RECIPROCATING CARRIAGE

[76] Inventor: Joseph H. Green, 36-8041 A Landmark Cir., Tampa, Fla. 33634

[21] Appl. No.: 22,984

[22] Filed: Feb. 26, 1993

[51] Int. Cl.[5] ..... F01B 29/00

[52] U.S. Cl. ..... 92/88; 92/137; 277/DIG. 7

[58] Field of Search ..... 92/88, 137, 165 R, 168, 92/169.1, 248, 249, 22, 24, 27; 277/DIG. 7

[56] References Cited

U.S. PATENT DOCUMENTS

| | | | |
|---|---|---|---|
| 2,473,430 | 6/1949 | Hoffar . | |
| 2,502,487 | 4/1950 | Scholl . | |
| 3,421,718 | 1/1969 | Gehringer et al. . | |
| 3,470,793 | 10/1969 | Hanchen . | |
| 3,592,131 | 7/1971 | Otsuka et al. . | |
| 3,717,071 | 2/1973 | Gordon | 92/137 |
| 4,057,257 | 11/1977 | Berg . | |
| 4,121,840 | 10/1978 | Berg . | |
| 4,351,628 | 9/1982 | Drexel et al. . | |
| 4,419,924 | 12/1983 | Peter et al. . | |
| 4,471,686 | 9/1984 | Garlapaty | 92/24 |
| 4,519,297 | 5/1985 | Lipinski . | |
| 4,537,113 | 8/1985 | Stoll et al. . | |
| 4,545,290 | 10/1985 | Lieberman . | |
| 4,664,019 | 5/1987 | Lipinski et al. . | |
| 4,664,020 | 5/1987 | Kaiser . | |
| 4,694,733 | 9/1987 | Green | 92/137 X |
| 4,724,744 | 4/1988 | Rosengren . | |
| 4,735,047 | 4/1988 | Wiedmann . | |
| 4,785,716 | 11/1988 | Vaughn et al. . | |
| 4,813,341 | 3/1989 | Vaughn . | |
| 4,829,881 | 5/1989 | Taki et al. . | |
| 4,838,147 | 6/1989 | Grishchenko | 92/88 |
| 4,852,465 | 8/1989 | Rosengren . | |
| 4,856,415 | 8/1989 | Noda | 92/88 |
| 4,891,908 | 1/1990 | Aquilina | 92/88 X |
| 5,035,171 | 7/1991 | Gottling et al. | 92/137 |
| 5,174,551 | 12/1992 | Mintgen | 92/168 X |

FOREIGN PATENT DOCUMENTS

| | | | |
|---|---|---|---|
| 2359013 | 5/1975 | Fed. Rep. of Germany | 92/137 |

*Primary Examiner*—Edward K. Look
*Assistant Examiner*—Hoang Nguyen
*Attorney, Agent, or Firm*—Gifford, Groh, Sprinkle, Patmore and Anderson

[57] ABSTRACT

A rodless piston and cylinder assembly having an improved cable connection between the ends of the piston and the working unit in the form of a band of plastic and coated stainless steel strip. The exterior surface of the band is curvilinear and cooperates with the curvilinear slot shape of piston and cylinder plastic sealing grommets. Braking of the working unit is accomplished by pistons in the carriage acting against the carriage slide.

18 Claims, 4 Drawing Sheets

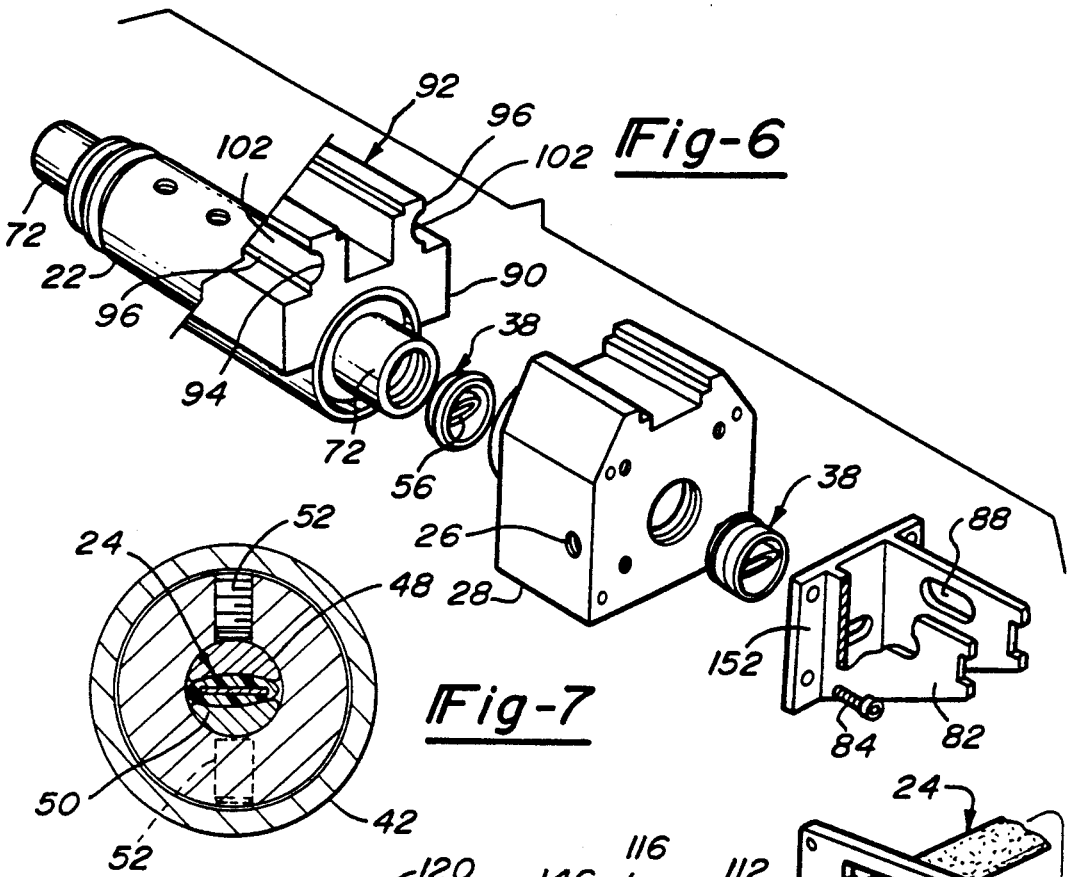
Fig-6
Fig-7
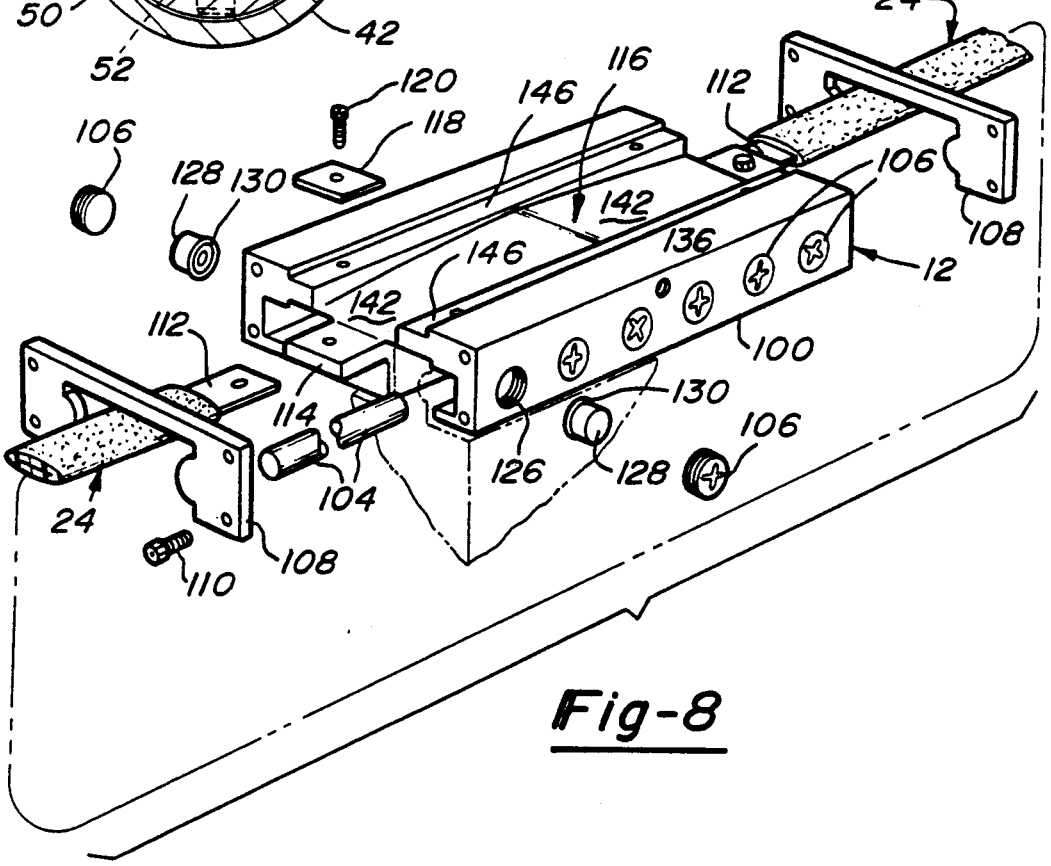
Fig-8

RODLESS PISON AND CYLINDER ASSEMBLY FOR A RECIPROCATING CARRIAGE

BACKGROUND OF THE INVENTION

1. Field of the Invention

The present invention relates to a rodless piston and cylinder assembly, and, more particularly, to improvements in such an assembly where the piston reciprocates a working member through a cable attached to the piston and extending out of the ends of the cylinder to the working member.

The present invention pertains to improvements in the cable and in the means for braking the working member, particularly where the working member is in the form of a reciprocating carriage.

2. State of the Prior Art

Generally there are two types of rodless piston actuators. In one type a cable is attached to one end of the piston and passes out of the cylinder around a pulley to one end of an actuator. Another cable portion is attached to the other end of the piston and passes out the cylinder around a pulley and is attached to the other end of the actuator. The actuator then moves in synchronism with, but in the opposite direction from the piston. Typically the cable is a multi strand wire rope which may or may not be coated. Appropriate seals are used where the cable passes through the cylinder.

In another type of rodless piston, the actuator is attached to the piston and passes radially outward through a slot in the cylinder. A flexible seal closes the slot along the length of the cylinder and must move to permit movement of the actuator.

In both types of rodless pistons, braking of the system is most often accomplished between the piston and the cylinder. Many of these devices utilize a wedge carried by the piston which brakes against only one side of the cylinder causing a force concentration which tends to gall the surface of the cylinder wall eventually necessitating expensive repair or replacement of the cylinder. There have been many improvements over this basic system such as that set forth in U.S. Pat. No. 4,471,686 assigned to Greenco Corporation, the Assignee of this present invention wherein a double acting piston has two sliding members which accomplish the braking around the entire periphery of the cylinder.

SUMMARY OF THE PRESENT INVENTION

The present invention provides a rodless cylinder with an improved cable and braking mechanism.

The rodless piston and cylinder assembly includes an elongated cylinder with a piston mounted for reciprocation within the cylinder. The conventional cable is replaced with a band which is connected to the piston and passes out of the opposed ends of the cylinder for engaging the working unit. The band is a metal strap having a molded plastic coating with a curvilinear exterior surface. A molded plastic sealing grommet is located at each of the opposed ends of the cylinder and has a curvilinear shaped slot which conforms to the curvilinear exterior surface of the band through which the band passes. The plastic coating of the band and the sealing grommet are preferably a polyurethane.

In one embodiment, the piston is positionable relative to the band and is releasably connected to the band. The band passes through a bore in the piston and is clamped to the band by diametrically opposed shoes which are pressed into contact with the band by set screws. In this embodiment, the piston is also sealed at its opposed ends with inserts similar to the grommets at the ends of the cylinders, having curvilinear shaped slots conforming to the curvilinear exterior of the band.

In a preferred embodiment of the invention the band is connected to a carriage as the working unit for reciprocation on a slide or guiding support. The support has a pair of longitudinally extending parallel rails, each of the rails having an outwardly facing guide surface and an inwardly facing braking surface. The carriage has a pair of spaced longitudinally extending flanges which cooperate with the outwardly facing guide surfaces of the rail for guiding the carriage as it is reciprocated on its rails. The carriage further has a centrally located, longitudinally extending brake bar located between the rails of the slide and containing a plurality of longitudinally spaced cylindrical bores. Braking pistons are located in the cylindrical bores and are arranged so that when fluid pressure is introduced into the cylindrical bores, the pistons are moved outwardly against the inwardly facing braking surfaces of the rails. Preferably, the braking pistons are also made with a polyurethane. Preferably with this type of assembly, longitudinally extending cylindrical gibs are located in longitudinally extending guide channels in the outwardly facing guide surfaces of the rails. The flanges of the carriage have a plurality of longitudinally spaced threaded plugs for exerting selective force against the longitudinally extending gibs. Preferably the gibs are made with an ultra-high molecular weight polyethylene, UHMWPE.

BRIEF DESCRIPTION OF THE DRAWING

The advantages of the present invention will be more apparent from the following detailed description when considered in connection with the accompanying drawing wherein:

FIG. 6 is an exploded perspective view showing the assembly of the piston and cylinder and its seals;

FIG. 7 is a cross sectional view taken along line 7—7 of FIG. 3;

FIG. 8 is an exploded perspective view showing the details of the braking mechanism and the assembly of the band to the carriage.

DETAILED DESCRIPTION OF THE PREFERRED EMBODIMENTS OF THE PRESENT INVENTION

Figures 1, 2:
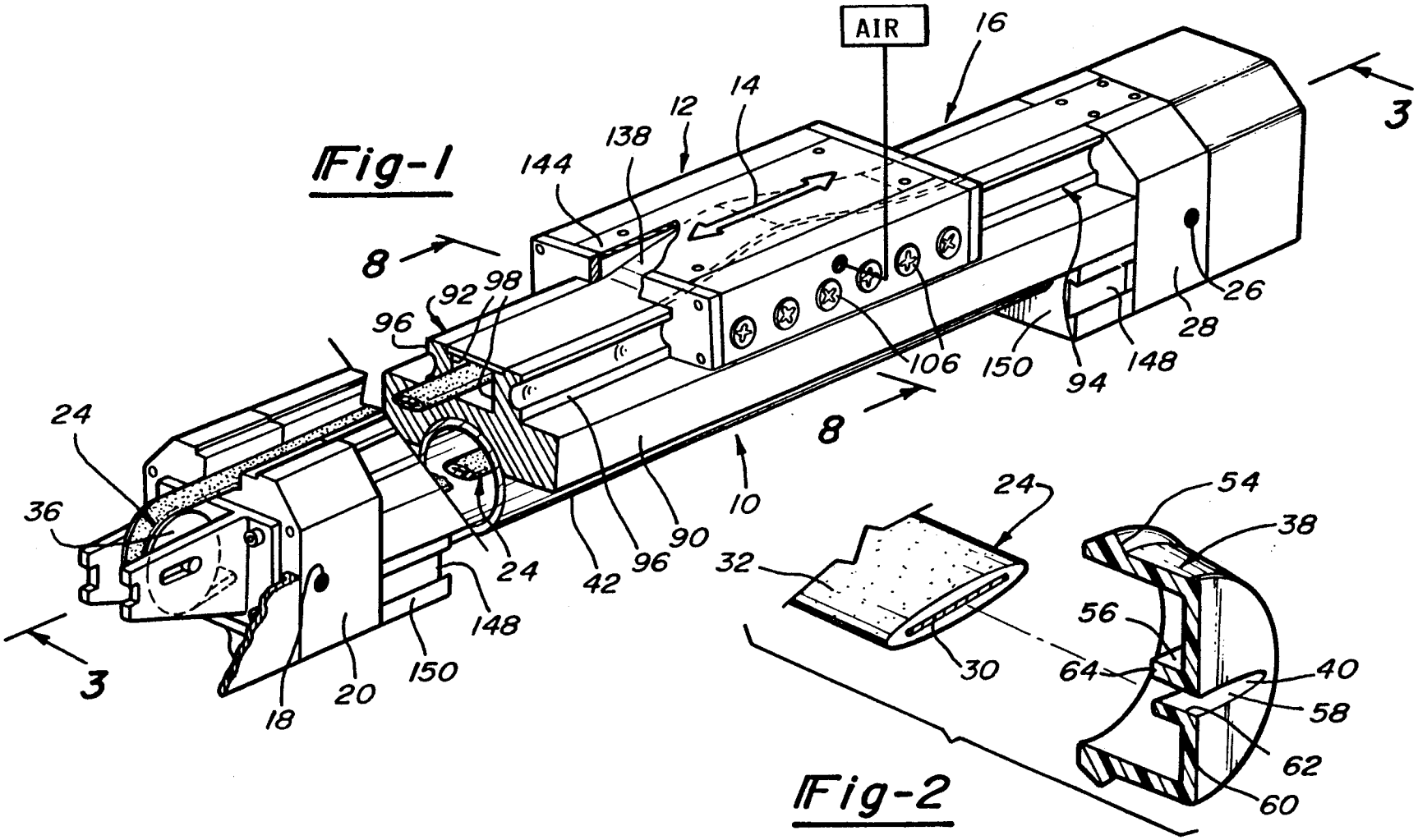
FIG. 1 is a perspective view with a portion broken away to show the integral structure of the cylinder and the improved band which passes out of the cylinder and is connected to the carriage which reciprocates on an integral guiding support.
FIG. 2 is a fragmentary enlarged perspective view showing the structure of the band and grommet or insert sealing member.
Figure 3:
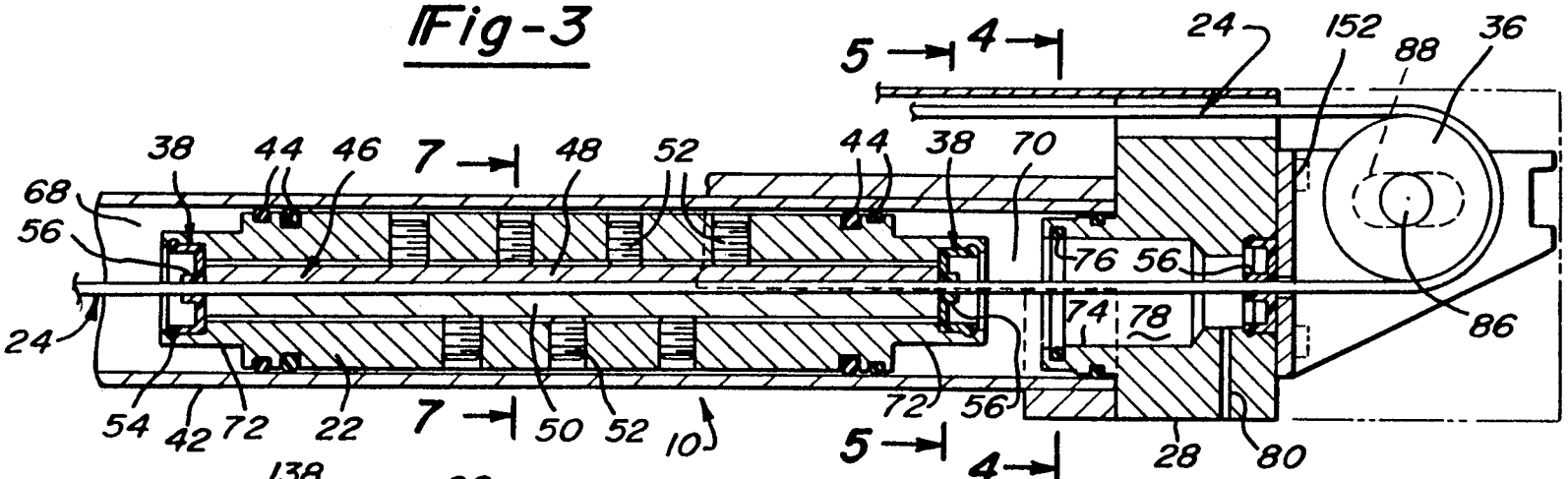
FIG. 3 is an elevational sectional view, taken along line 3—3 of FIG. 1, showing the piston and the manner of attaching the piston to the band including the sealing mechanism and the entrainment of the band around a pulley to direct it towards the carriage.

Referring to FIGS. 1-3, the piston and cylinder assembly 10 is shown in an integrated structure with carriage 12 serving as the working member mounted for reciprocation in the directions of arrow 14 on slide or guiding support 16.

As viewed in FIGS. 1 and 3, when air is introduced through air intake 18 of cylinder head 20, piston 22 moves to the right causing the carriage 12 to move to the left through interconnecting band 24. When air is introduced into air inlet 26 in cylinder head 28, piston 22 moves to the left causing the carriage 12 to move to the right.

Figure 4:
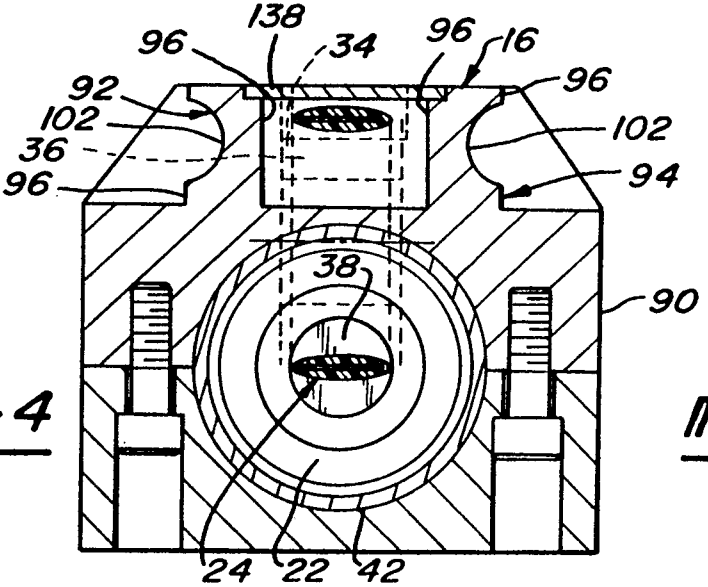
FIG. 4 is a cross sectional view taken along line 4—4 of FIG. 3.

The band 24 of this invention replaces the conventional cable. As best seen in FIG. 2, band 24 is constructed with a stainless steel strap 30 having a molded plastic coating 32 with a continuous curvilinear exterior surface. This continuous curvilinear surface has an elliptical perimeter with a relatively large major axis compared to the minor axis. For example, with a 1½" cylinder, strap 30 will have a width of ½" and a thickness of 0.008-0.010". With the plastic coating, the thickness at the center of the belt would be approximately 3/32" with approximately 3/64" diameter at both ends and an overall width of 0.525". The plastic coating is preferably a flexible polyurethane. This band structure provides a very stable, non-twisting assembly which is less likely to be frayed than a cable structure. It also provides, with a conforming curvilinear or semi-elliptical groove 34 of the pulleys 36 at each end of the cylinder, a more positive drive than a cable, see FIG. 4. Sealing grommet 38 is also a molded plastic, preferably polyurethane having a slot 40 with a curvilinear shape which conforms to the curvilinear shape of the exterior band coating 32.

Referring to FIGS. 3 and 7, the piston 22 is arranged to reciprocate in cylinder 42 having suitable seals 44 arranged at both ends of the piston 22. The piston has a hollow through-bore 46 through which the band 24 passes. Arranged on diametrically opposite sides of the belt are a pair of shoes 48 and 50 which have a radially inner surface which conforms to the curvilinear exterior surface of the band 24. Staggered, diametrically opposed set screws 52 are used to apply pressure to the shoes 48 and 50 to retain the band 24 attached to the piston 22.

A sealing grommet 38 is snapped into each end of the piston 22 with the grommet flange 54 snapping into a corresponding groove in the end of the piston. Sealing slot 40 is contained in a nozzle like projection 56 of the grommet 58 and tapers inwardly from a larger opening 58 at the grommet back wall 60 to a smaller opening 62 at the face 64 of the nozzle projection. This effectively seals air from entering from the left hand air chamber 68 or the right hand air chamber 70 into the bore 46 of the piston 22.

Piston 22 has a smaller diameter ends 72 which are received in bores 74 in the cylinder blocks 20 and 28. Seal 76 cooperates with piston end 72 to compress air in cylinder head chamber 78 to dampen the piston travel at each end of the cylinder. Working fluid is allowed to bleed out of chamber 78 through passage 80. A sealing grommet 38 is snapped into the ends of cylinder blocks 20 and 28 with the grommet flange 54 snapping into a corresponding groove in the end of the cylinder blocks and with the smaller opening of the nozzle projection 56 facing inward to effectively seal against any working fluid passing out of the cylinder ends as the belt exits through slot 40.

Pulley brackets 82 are mounted to the cylinder blocks 20 and 28 by machine screws 84 to adjustably receive the end pulleys 36 with their axles 86 mounted in bracket slots 88.

Referring to FIGS. 1 and 6, the slide or guiding support 16 is mounted on top of cylinder 42 and extends its entire length between cylinder head 20 and 28. It includes a base portion 90 and a pair of longitudinally extending integral rails 92 and 94. Each of the rails 92 and 94 has an outwardly facing guide surface 96 and an inwardly facing braking surface 98.

Figure 9:
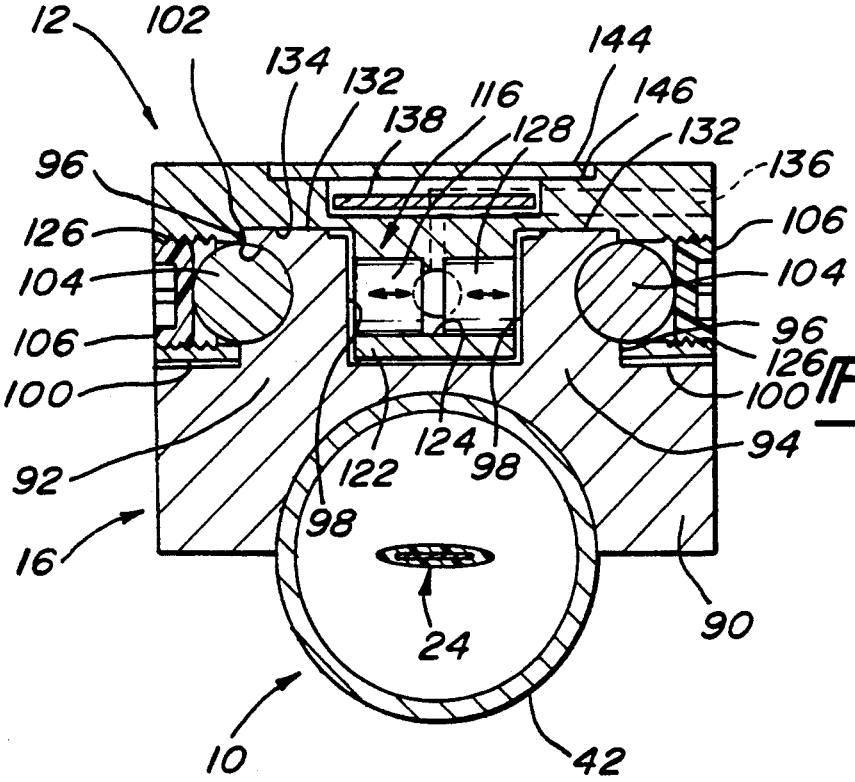
FIG. 9 is a sectional view through the carriage and its guiding support showing the braking piston in their working position relative to the guiding gibs for the carriage.

Referring primarily to FIGS. 1, 8 and 9, the carriage 12 has a pair of spaced, longitudinally extending flanges 100 which cooperate with the outwardly facing guide surfaces 96 of rails 92 and 94 to guide the carriage as it is reciprocated on slide 16. Preferably, the guide surfaces 96 of rails 92 and 94 have longitudinally extending guide channels 102 in which bearing rods or gibs 104 traveling with the carriage, ride. Bearing force is adjusted by a series of longitudinally spaced plugs 106 which are threaded into threaded apertures 126 in flanges 100 of the carriage. The gibs are preferably made with an ultra high molecular weight polyethylene, UHMWPE, material for excellent bearing qualities. The gibs 104 are maintained for movement with carriage 12 by end plates 108 secured by machine screws 110.

The plastic coating 32 is stripped from the ends 112 of band 24, and the ends are secured to mounting flanges 114 of central carriage member 116 by fastener plates 118 and screws 120.

Referring to FIG. 9, the central carriage member 116 has a depending brake bar 122 having longitudinally spaced cylinder bores 124 in line with the threaded aperture 126 in carriage flanges 100 which house the bearing force adjustment plugs 106.

Plastic braking piston 128, preferably made with polyurethane, having a flexible flange portion 130 (See FIG. 8) are inserted through the threaded apertures 126 of flanges 100 into the cylinder bores 124 in the central brake bar 122 before the carriage 12 is placed over the slide 16. With the braking pistons in place and the carriage located on the slide, the bearing gibs 104 are inserted and are retained by carriage end plates 108. Bearing force can then be adjusted by threading plugs 106 into threaded apertures 126 and adjusting the force by final positioning of the plugs 106.

When the carriage 12 is reciprocated on slide 16, the gibs 104 located between the carriage flanges 100 and the grooves 102 in rails 92 and 94 will keep the carriage aligned and operating smoothly. Additionally, the top surface 132 of rails 92 and 94 will support the carriage through bottom carriage surface 134; see FIG. 9.

To accurately stop the movement of carriage 12 air is introduced through passageway 136 to the cylinder bores 124, moving the braking pistons 128 outwardly against the braking surfaces 98 of rails 92 and 94. The use of multiple braking pistons acting on each rails assures accurate and rapid braking of the carriage to a complete stop.

Figure 5:
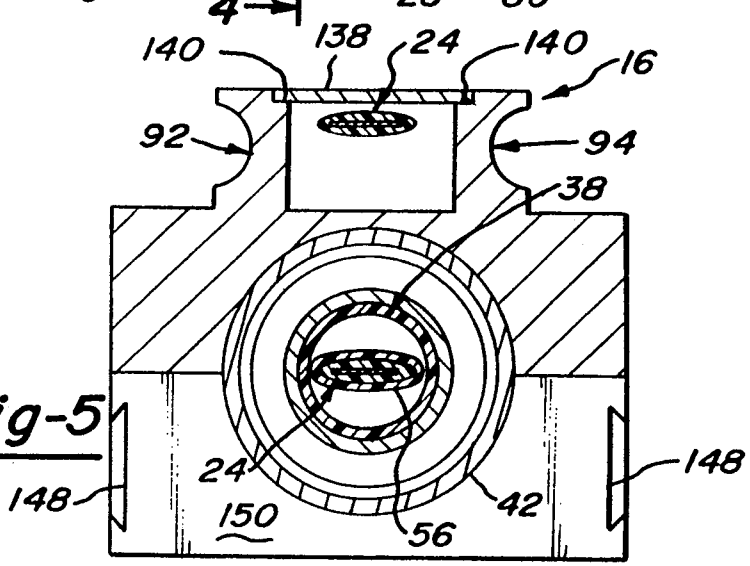
FIG. 5 is a cross sectional view similar to FIG. 4 taken along line 5—5 of FIG. 3.

Slide cover 138 is attached at each of its ends to cylinder heads 20 and 28. This cover spans the rails 92 and 94 being contained in the top recess 140 of each rail; see FIG. 5. Slide cover 138 is lifted out of these recess 140 by the sloping surfaces 142 of the central carriage member 116 as the carriage is reciprocated; see FIG. 8 which shows these surfaces without the slide cover. Finally carriage cover 144 is retained in recesses 146 of the central carriage member 116 as seen in FIGS. 1, 8 and 9.

The piston and cylinder assembly 10 with its integral working unit, carriage 12 and slide 16, can be mounted in various ways in its working environment. For example, dove tail grooves 148 in slide support blocks 150 can be used to accomplish such mounting. Various features are inherent in this structure described and depicted in the drawing. Also obvious modifications to suit a particular application will be apparent. For example, the carriage position relative to the piston stroke can be adjusted by loosening set screws 52 and moving the band 24 relative to retaining shoes 48 and 50. Sealing grommet 38 and cylinder heads 20 and 28 are kept clean and are further retained by back plate 152 of pulley mounting bracket 82. The sealing of the main working piston 22 and the brake pistons 128 allows air actuation or hydraulic fluid actuation.

I claim:

1. A rodless piston and cylinder assembly comprising:

an elongated cylinder;

a piston mounted for reciprocation in said cylinder;

a band connected to said piston and passing through seals located at opposed ends of said cylinder and engaging a carriage for reciprocation of said carriage on a guiding support;

said support having a pair of longitudinally extending parallel rails, each rail having an outwardly facing guide surface and an inwardly facing braking surface;

said carriage having a pair of spaced, longitudinally extending flanges which cooperate with the outwardly facing guide surfaces of said rail for guiding said carriage as it is reciprocated on said rails;

said carriage further having a centrally located, longitudinally extending brake bar located between said rails and containing a plurality of longitudinally spaced cylinder bores; and a plurality of braking pistons located in said cylinder bores and being operable when fluid pressure is introduced into said cylinder bores to move outwardly against the inwardly facing braking surfaces of said rails.

2. The assembly according to claim 1 and including said band connected to said piston passing out of opposed ends of said cylinder for engaging a working unit and wherein said band is a metal strap having a molded plastic coating with a curvilinear exterior surface.

3. The assembly according to claim 2 wherein the molded plastic coating of said band and the molded sealing grommet are a polyurethane.

4. The assembly according to claim 2 wherein said piston has a longitudinally extending through-bore through which said band passes.

5. The assembly according to claim 4 wherein said piston is releasably connected to said band.

6. The assembly according to claim 5 wherein said piston is releasably connected to said band by the use of set screws.

7. The assembly according to claim 6 wherein diametrically opposed shoes located in said through-bore are pressed into contact with said band by said set screws.

8. The assembly according to claim 4 including a pair of plastic sealing inserts and wherein one of said plastic sealing inserts is located at each end of said piston, said inserts having a curvilinear shaped slot conforming to the curvilinear exterior surface of said band.

9. The assembly according to claim 1 wherein said braking pistons are made with polyurethane.

10. The assembly according to claim 1 further including longitudinally extending cylindrical gibs located in longitudinally extending guide channels in the outwardly facing guide surfaces of said rails; and the flanges of said carriage have a plurality of longitudinally spaced threaded plugs for exerting selective force against said longitudinally extending gibs.

11. A rodless piston and cylinder assembly comprising:

an elongated cylinder;

a piston mounted for reciprocation in said cylinder, said piston has a longitudinally extending through-bore;

a band connected to said piston and passing through said longitudinally extending through-bore and out of opposed ends of said cylinder for engaging a working unit;

said piston is releasably connected to said band by the use of set screws and wherein diametrically opposed shoes located in said through-bore are pressed into contact with said band by said set screws;

wherein said band is a metal strap having a molded plastic coating with a curvilinear exterior surface; and a molded plastic sealing grommet located at each of the opposed ends of said cylinder having a curvilinear shaped slot, conforming to the curvilinear exterior surface of said band, through which said band passes.

12. A rodless piston and cylinder assembly comprising:

an elongated cylinder;

a piston mounted for reciprocation in said cylinder, said piston has a longitudinally extending through-bore;

a band connected to said piston and passing through said longitudinally extending through-bore and out of opposed ends of said cylinder for engaging a working unit;

wherein said band is a metal strap having a molded plastic coating with a curvilinear exterior surface;

a pair of plastic sealing inserts with one insert located at one end of said piston and the other insert located at the opposite end of said piston, said inserts having a curvilinear shaped slot conforming to the curvilinear exterior surface of said band; and a molded plastic sealing grommet located at each of the opposed ends of said cylinder having a curvilinear shaped slot, conforming to the curvilinear exterior surface of said band, through which said band passes.

13. A rodless piston and cylinder assembly comprising:

an elongated cylinder;

a piston mounted for reciprocation in said cylinder;

a band connected to said piston and passing out of opposed ends of said cylinder, said band is a metal strap having a molded plastic coating with a curvilinear exterior surface;

a molded plastic sealing grommet located at each of the opposed ends of said cylinder having a curvilinear shaped slot conforming to the curvilinear exterior surface of said band through which said band passes, said band is connected to a carriage as a working unit for reciprocating on a guiding support;

said support having a pair of longitudinally extending parallel rails, each rail having an outwardly facing guide surface and an inwardly facing braking surface;

said carriage having a pair of spaced, longitudinally extending flanges which cooperate with the outwardly facing guide surfaces of said rails for guiding said carriage as it is reciprocated on said rails;

said carriage further having a centrally located, longitudinally extending brake bar located between said rails and containing a plurality of longitudinally spaced cylinder bores; and a plurality of braking pistons located in said cylinder bores and being operable when fluid pressure is introduced into said cylinder bores to move outwardly against the inwardly facing braking surfaces of said rails.

14. The assembly according to claim 13 wherein said braking pistons are made with polyurethane.

15. The assembly according to claim 13 wherein breaking means are interposed between the outwardly facing guide surfaces of said rails and the flanges of said carriage.

16. The assembly according to claim 15 wherein said bearing means includes longitudinally extending cylindrical gibs located in longitudinally extending guide channels in the outwardly facing guide surfaces of said rails.

17. The assembly according to claim 16 wherein said gibs are made with UHMWPE.

18. The assembly according to claim 16 wherein the flanges of said carriage have a plurality of longitudinally spaced threaded plugs for exerting selective force against said longitudinally extending gibs.

* * * * *